United States Patent [19]

Wiard et al.

[11] Patent Number: 4,607,684

[45] Date of Patent: Aug. 26, 1986

[54] LEAK PROTECTED HEAT EXCHANGER

[75] Inventors: Maxwell R. Wiard, Vandalia; Kenneth L. Michael, Dayton, both of Ohio

[73] Assignee: United Aircraft Products, Inc., Dayton, Ohio

[21] Appl. No.: 692,762

[22] Filed: Jan. 18, 1985

[51] Int. Cl.[4] ..... F28F 11/00

[52] U.S. Cl. ..... 165/70; 165/166; 165/916

[58] Field of Search ..... 165/70, 72, 166, 11 R

[56] References Cited

U.S. PATENT DOCUMENTS

| | | | |
|---|---|---|---|
| 2,846,198 | 8/1958 | Sturges | 165/70 |
| 3,469,623 | 9/1969 | Rawlings | 165/70 |
| 3,825,061 | 7/1974 | Bathla | 165/70 |

FOREIGN PATENT DOCUMENTS

| | | | |
|---|---|---|---|
| 0131697 | 10/1980 | Japan | 165/70 |

OTHER PUBLICATIONS

Stanley Yokell, Double-Tubesheet Heat-Exchanger Design Stops Shell-Tube Leakage, from Chemical Engineering, 5/14/73, pp. 33, 34.

*Primary Examiner*—William R. Cline
*Assistant Examiner*—Richard R. Cole
*Attorney, Agent, or Firm*—J. E. Beringer

[57] ABSTRACT

A plate and fin type heat exchanger in which different flowing fluids are placed in a segregated heat transfer relation and in which provision is made to deny opportunity for a leaked fluid from one flow or circuit to join or mix with fluid of another flow or circuit. A concept of vented buffer zones is used to protect against leakage through plate elements and through defined joints between plate and spacer elements. The concept allows and provides for relatively simple manifolding and for fabrication to conventional configurations using for the most part standard easily manufactured parts.

11 Claims, 7 Drawing Figures

LEAK PROTECTED HEAT EXCHANGER

BACKGROUND OF THE INVENTION

1. Field of the Invention

This invention relates to fluid to fluid heat exchangers and particularly to structural features thereof reducing the likelihood of fluid mixing as may result from leakage caused by wear, corrosion, imperfect braze joints or the like.

2. Description of the Prior Art

In a common form of fluid to fluid heat exchanger, plate elements and spacer elements are effectively stacked or assembled so that they define multiple superimposing or side by side fluid flow passages. Through use of applied manifolds, or other means, first and second fluids are directed through alternating passages, with a transfer of heat taking place from the fluid of higher temperature to the fluid of lower temperature through the plate separating adjacent passages. Usually a strip of corrugated fin material is placed in each flow passage to make the heat transfer process more efficient and to promote structural strength and rigidity. After assembly, and in a preferred joining process, parts are united into a one-piece structure by a brazing process in which plate elements are made fast to spacer elements upon which they superimpose and the peaks and valleys of the corrugated fin material attach to overlying and underlying plate elements. In various ways, braze material is introduced at joints where parts contact one another, and, in the presence of heat and pressure, the material flows to fill the defined joints. The braze connection is multi-functional. It connects the parts in a uniform assembly. It provides for heat flow with minimal thermal resistance, and, it seals the defined joints against fluid leaks. Since at least one of the flowing fluids is often under relatively high pressure, great care is usually taken to insure that the braze joints are sound and well sealed.

Heat exchangers as described have enjoyed a long commercial success. They lend themselves particularly well to fabrication using light weight metals. They are easy to manufacture, all of the braze joints being effected in a single operation, and they are highly efficient.

However, use requirements are sometimes quite severe. In some applications, for example, even minor amounts of leakage from one flow circuit to another cannot be tolerated. When made under carefully controlled conditions and subjected to repeated inspections, a leak proof heat exchanger can be produced. Such manufacture may not always be economically feasible, however, and is in any event no guarantee that leaks will not develop in service. Common causes of leaks are weakly brazed joints not adequately resistant to vibration and pressure stresses, and imperfections in a plate element developing pin hole leaks in the manufacturing process or as a result of corrosion. One or both of the fluids put through the heat exchanger may be corrosive or entrain corrosive materials. One practiced brazing process is carried out in a salt bath and, with occasionally imperfect results, subsequent flushing procedures are used to wash salt residue from interior passages.

In addition to efforts made to make the heat exchanger leak proof, concurrent efforts have been made to render leaks harmless, that is, to prevent fluid interchange from one flow circuit to another. In one prior art example, shown in P. Bathla U.S. Pat. No. 3,825,061, issued July 23, 1974, plate elements are configured as unitary tubes leaving the fluid conducted therethrough no opportunity to leak through brazed joints. Also, through a use of superstructure built up at either end of the heat exchanger, drained collection chambers are provided for fluid which may leak past those braze joints which at other locations separate the fluid circuits. The prior art construction adequately serves its intended purpose. Certain disadvantages and limitations attend its use, however. Thus, the integrally formed tubes and components comprising the end superstructure are not usual or conventional in plate and fin constructions. Their use adds substantially to the difficulties and cost of manufacture. Further, the prior art device does not take into account or provide for leakage through plate elements defining the flow passages. As seen above, these can be the source of leaks as well as can the braze joints.

SUMMARY OF THE INVENTION

This invention presents a leak protected heat exchanger overcoming disadvantages and limitations of the known prior art. The core construction is made up of standard, readily available parts. The parts are, moreover, assembled in a conventional manner requiring no special skills and the resulting structure is free of unconventional superstructure or the like. The core construction features a use of buffer zones or collection chambers totally integrated into basic outlines of the core unit. They include buffer zones between flow passages for the different flowing fluids and buffer zones surrounding the flow passage of a high temperature, high pressure fluid. Buffer zones are communicated to the core exterior through a face thereof. A relatively simple manifold is fixed to the core at that face and includes means to conduct the high pressure, high temperature fluid to the face as well as a vent chamber to receive leaked fluids.

An object of the invention is to provide a leak protected heat exchanger substantially as above set forth.

Other objects and structural details of the invention will appear from the following description when read in connection with the accompanying drawing, wherein.

Figure 1:
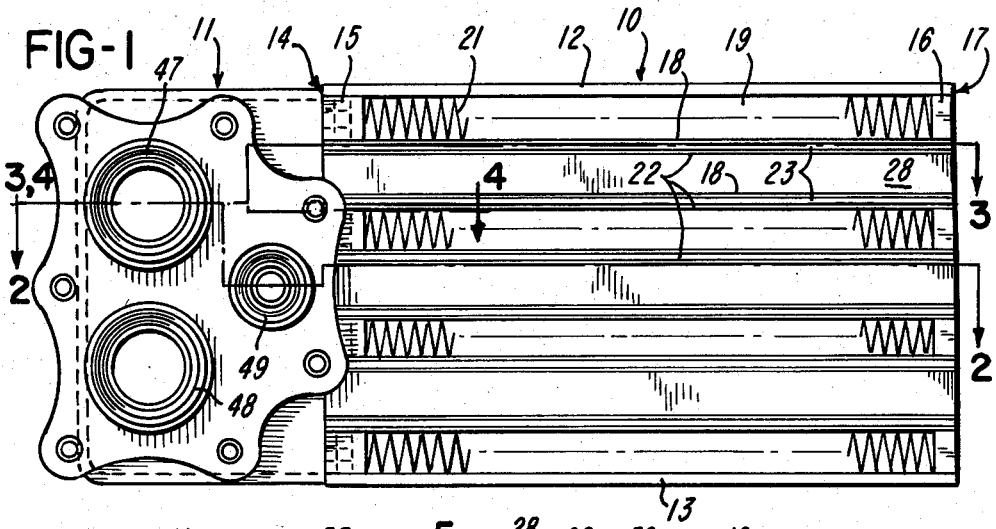
FIG. 1 is a top plan view of a leak protected heat exchanger in accordance with the invention embodiment.

Referring to the drawings, a heat exchanger assembly according to the invention embodiment illustrated is adapted to be submerged in a body of liquid, as in a fuel tank in a fuel burning engine system. The liquid has access to through open passages or passes in the heat exchanger and in those passages is in a heat transfer relation to another fluid which in a separate, segregated circuit is caused to flow through other heat exchanger passages or passes. In the present instance the liquid serves as a coolant for the relatively hot fluid of the segregated circuit. Temperature differentials provide for an induced convection flow of the liquid in through, open passages of the heat exchanger. The relatively hot fluid flows under externally generated system pressure. For convenience of description, the liquid will hereinafter be referred to as fuel and the relatively hot fluid as air, for example high pressure, high temperature bleed air as drawn from a gas turbine engine to perform various functions in an aircraft or like environment.

The heat exchanger comprises a core 10 and a manifold 11. The core 10 has a rectangular configuration. The manifold 11 is fixed, as by welding, to one end face of the core. Top and bottom core surfaces, as viewed in FIG. 1, are defined by respective flat plates or core sheets 12 and 13. Between the core sheets 12 and 13 are multiple spacer elements and other flat plates or tube sheets, to be more particularly identified hereinafter, cooperating to define the several described passages. That face of the heat exchanger to which manifold 11 attaches may be designated as a face 14 in part formed by corresponding ends of the plates 12 and 13.

Immediately adjacent to the plate 12 are longitudinally spaced apart spacer elements 15 and 16, parallel to one another. The former positions at and in part defines the face 14 and in length is substantially coextensive with the width of plate 12. The latter in part defines an opposite end face 17 of the heat exhanger core. The elements 15 and 16 space plate 12 from a tube plate or sheet 18 configured like plate 12 but made of relatively thinner sheet material. Together, the plates 12 and 18 and spacer elements 15 and 16 form a passage 19 open from top to bottom of the core, or from side to side as seen in FIG. 1. In the passage 19 is a corrugated strip of fin material 21.

Figure 3:
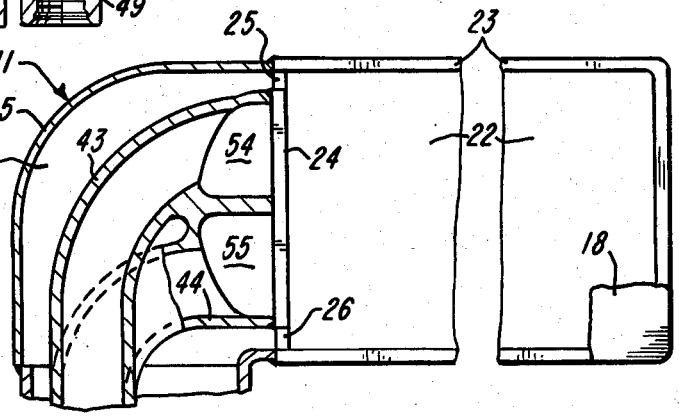
FIG. 3 is a view in longitudinal section taken substantially along the line 3—3 of FIG. 1.
Figure 4:
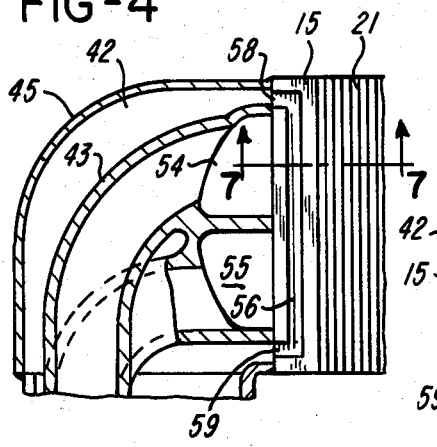
FIG. 4 is a fragmentary view in longitudinal section taken substantially along the line 4—4 of FIG. 1.

The tube sheet 18 overlies (as seen in FIG. 1) a like sheet 22 and is spaced therefrom by a pair of spacer elements 23 and 24 (FIG. 3). The former has a U-shape, its closed end positioning at and in part defining the face 17 and its open end positioning at and in part defining the face 14. Element 24 is in the same plane as element 23 and disposes transversely across the open end thereof. Its length, however, is somewhat less than the width of element 23 and, when positioned centrally of the open arms of element 23, leaves spaced apart apertures 25 and 26 opening through face 14. Together, the tube sheets 18 and 22 and spacer elements 23 and 24 define a space 27 which for reasons which will later more clearly appear, is designated a collection chamber. The chamber 27 is open to the exterior of the heat exchanger core through the apertures 25–26 in core face 14. The spacer elements 23 and 24 are short in height, as compared to spacer elements 15 and 16, so that tube sheets 18 and 22 are much more closely adjacent than are side wall 12 and tube sheet 18. The chamber 27 is, therefore, shallow or narrow as compared to passage 19.

Figure 2:
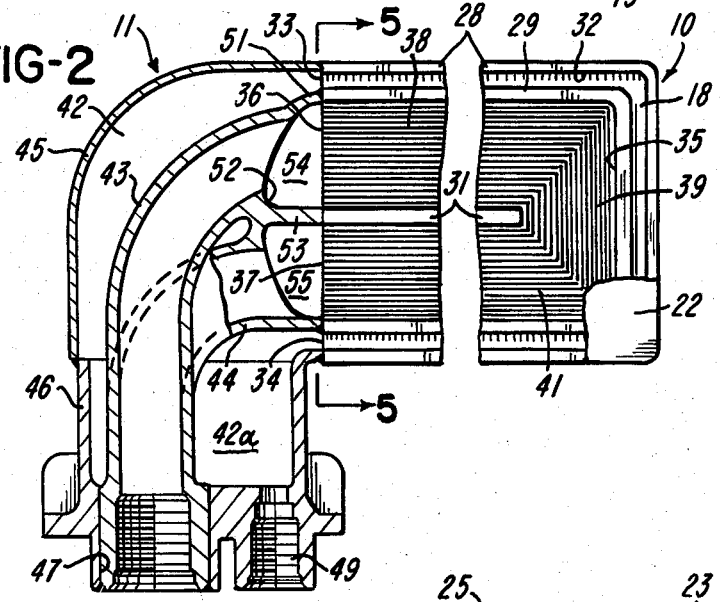
FIG. 2 is a view in longitudinal section taken substantially along the line 2—2 of FIG. 1.

The tube sheet 22 overlies another sheet 18 and is spaced therefrom by multiple spacer elements 28, 29 and 31 (FIG. 2). Element 28 is structured and orients like spacer element 23. It has a U-shape, its closed end positioning at and in part defining the face 17 and its open end positioning at and in part defining the face 14. Element 29 is in the same plane as element 28 and is similarly structured but made smaller so as to nest within and in a spaced relation to element 28. The arrangement leaves a space 32, which may also be regarded as a collection chamber, between elements 28 and 29. The open ends of the spacer elements 28 and 29, along with overlying and underlying sheets 22 and 18, define apertures 33 and 34 by which chamber 32 opens through face 14. The spacer element 31 is positioned centrally of and is embraced by the arms of element 29. Its one end terminates at face 14. Its opposite end terminates short of the closed end of element 29. The element 31 has the character of a divider and in conjunction with element 29 and overlying and underlying sheets 22 and 18 forms a fluid flow passage 35 having entrance and exit ends 36 and 37 at the face 14. Thus, fluid, in the present instance air, directed to entrance 36, flows longitudinally of passage 35 to one side of divider 31 and then transversely of the passage across the opposite or inner end of the divider to the other side thereof where it returns longitudinally of the passages to exit 37. The height of spacer elements 28, 29 and 31 corresponds approximately to that of spacer elements 15 and 16. Within the passage 35 are mating strips 38, 39 and 41 of corrugated fin material.

Below flow passageway 35 and collection chamber 32, as seen in FIG. 1, are means defining another collection chamber 27 and below that means defining another fuel passage 19, the pattern as described being repeated any desired number of times to complete a core assembly. In the illustrated instance, four fuel passages 19 are produced and three air passages 35, the air passages being in an alternating relation to the fuel passages and being separated therefrom by intervening collection chambers 27. A fuel passage 19 occurs adjacent each plate 12 and 13 so that no air passage lies adjacent to a side wall of the core. The several air and fuel passages and intervening collection chambers 29 are identical to one another.

To assemble the heat exchanger core, individual component elements are stacked one upon another, this being expeditiously done in a jig or fixture.

In the process, spacer elements 15–16, 23–24 and 28, 29 and 31 are effectively interposed between a core sheet and a tube sheet or between a pair of tube sheets. Also in the assembly process, or separately, braze material is introduced into joints as represented by areas of contact of sheet elements with spacer elements. In the presence of the braze material, parts are pressured into close intimate contact and the temperature of the assembled core raised to the melting point of the braze material. The braze material flows to fill the described joints, and, upon the core assembly being allowed to cool, component parts will be found to be joined together into a unitary whole by means constituting a seal and a bond. According to one brazing technique, plate and sheet elements 12–13 and 18 and 22 are clad with a braze material, this technique being particularly useful when it is desired that peaks and valleys of the fin material be brazed to overlying and underlying sheet elements.

Figure 5:
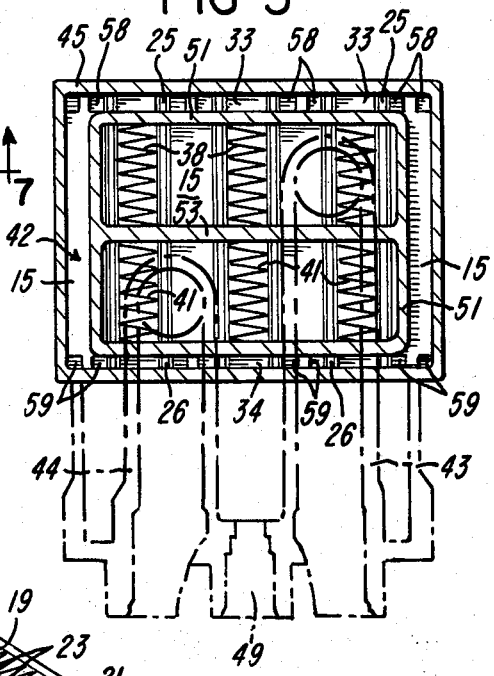
FIG. 5 is a view in cross section taken substantially along the line 5—5 of FIG. 2.

The manifold 11 is made in any appropriate manner to provide an interior vent chamber 42 (FIG. 2) and flow tubes 43 and 44 extending through the chamber 42. In the illustrated instance the manifold is made of a combination of machined and cast parts welded into unit form. An angular body 45 provides the larger portion of chamber 42 and at its one end has perimeter contact with face 14 of the core 10. Chamber 42 opens through such one end and so opens upon face 14 in communicating relation with apertures 25–26 and 33–34. The opposite end of body 45 has fixed thereto an extension portion 46, comprising an interior chamber **42*a*, which is a part of vent chamber 42**, and openings 47, 48 and 49 to outside of the manifold. Opening 49 communicates directly with chamber 42*a* and therefore with chamber 42. The openings 47 and 48 accommodate the presence of open ends of respective tubes 43 and 44. The latter extend through chamber 42*a* and into chamber 42 where they are commonly joined to a generally rectangular wall 51 (FIG. 5) in concentric inwardly spaced relation to that perimeter portion of body 45 contacting face 14. The wall 51 has a perimeter portion substantially bridging the space between spacer elements 29 and has a recessed frontal surface 52 opening upon face 14. The recessed surface 52 is split by a centrally positioning rib 53 of the wall 51 to form therein separated chambers 54 and 55. Tube 43 opens through the wall into chamber 54. Tube 44 opens through the wall into chamber 55. The divider rib 53 registers with the several divider elements 31, with chambers 54 and 55 aligning with and having common communication with the several air flow entrances 36 and exits 37 respectively.

Figure 6:
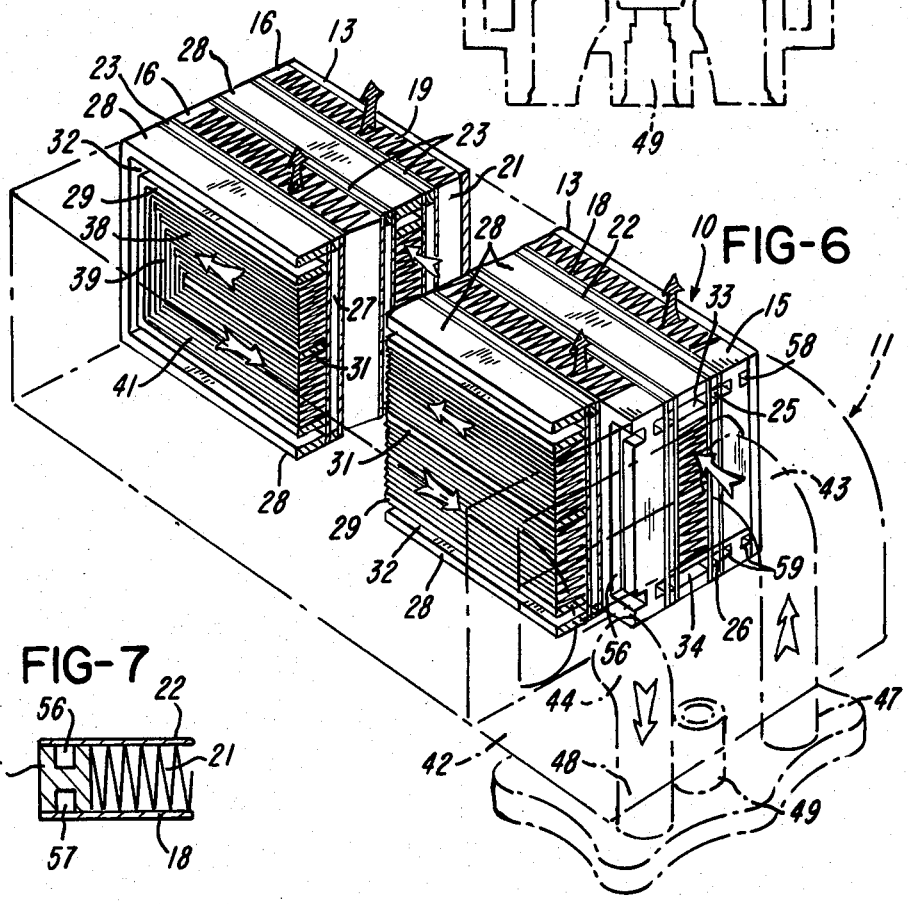
FIG. 6 is a view in perspective, and partly fragmentary, of the heat exchanger.
Figure 7:
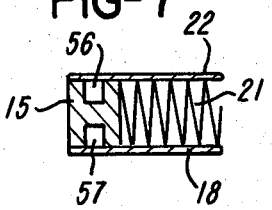
FIG. 7 is a detail view in cross section taken substantially along the line 7—7 of FIG. 4.

The manifold 11 is secured as by welding to the face 14 of the heat exchanger cone. Side walls 12 and 13, spacer elements which terminate at the face 14, and spacer elements (elements 15) which position at and transversely of the face 14, provide abutment surfaces to which perimeter wall portions of the manifold may be welded. Referring to the spacer elements 15, as shown in FIGS. 6 and 7, each has over a portion of its length intermediate its ends upper and lower longitudinal grooves or recesses 56 and 57. Where these grooves terminate adjacent to ends of the element, the element further is cut by slots 58 and 59 which are in common communication with grooves 56 and 57 and open, moreover, through face 14. The spacing of slots 58 and 59 is such as to locate them outside the bounds of manifold wall 51 whereby they communicate, along with apertures 25–26 and 33–34, with manifold vent chamber 42.

In the manifold, opening 49 connects vent chamber 42–42*a* to ambient surroundings or to a suitable low pressure drain. Openings 47 and 48, or more particularly tubes 43 and 44 installed therein, are connected in a system flowing high pressure, high temperature air. Tube 43 serves as the air inlet and conducts air to chamber 54 where it has simultaneous access to the inlets 36 of all air flow passages 35 in the core 10. Flowing through the several passages 35, in the route compelled by dividers 31, the air reaches exits 37 and discharges into chamber 55 to be conducted through and out of the manifold by the way of air outlet tube 44. Flow of the heated air in passage 35 takes place in the presence of relatively cool fuel in passages 19. A conducted transfer of heat takes place across the sheets 18 and 22 which separate the fuel and air passages with a consequent cooling of the flowing air. If desired, a fin material or the like may be placed in chambers 27, in contact with overlying and underlying tube sheets, for better heat conductance.

In the event of developed pin hole leaks or the like in tube sheets 18 or 22, leaked fluid, whether from the air or fuel circuit, has access only to a collection chamber 27 and not to fluid of the other circuit. In the event of leakage at joints where the tube sheets contact spacer elements 28 and 29, leaking air has access only to an intermediate chamber 32 and not to the fuel circuit. In the event of leakage at joints where side walls or tube sheets contact spacer elements 15, leaking fuel reaches the groove 56 or 57 and then slot 58 or 59 outside the air flow circuit. All leaked fluid, whether in collection chambers 27, intermediate chambers 32 or grooves 56–57 are communicated through core face 14 to vent chamber 42 of the manifold.

A particular invention embodiment has been disclosed for illustration purposes. It will be evident that modifications within the skill of those versed in the art may be made without departing from invention concepts. The use of integrated buffer zones within a heat exchanger core as here taught is believed to be broadly applicable in plate and fin type heat exchangers. Other manifolding arrangements are possible, and, of course, the fuel could be manifolded into and out of the core if the fuel circuit were intended to be a closed system.

In the claims, the fluid flowing passages 19 and 35 are termed "passes" in order better to distinguish from the marginal vent passage 32.

Spacer elements other than elements 31, since they occur at or adjacent to marginal edges of the heat exchanger core, may be termed marginal spacer elements.

What is claimed is:

1. A leak protected heat exchanger, including an assembly of stacked plate and fin and spacer elements defining layered flow passes for first and second fluids and between adjacent flow passes or different fluid flow collection chambers for receiving leaked fluid from said flow passes, means for separately communicating adjacent flow passes of different fluid flow with said first and second fluids, and means for venting said collection chambers, said stacked elements producing an assembly of generally angular configuration including an external face through which flow passes associated with a first fluid open and through which said collection chambers open, and including a manifold applied to said face structured to include passage means communicating with said first fluid passes and to include a vent chamber into which said collection chambers open.

2. A leak protected heat exchanger according to claim 1, wherein said flow passes and said collection chambers are defined by plate elements spaced apart by said spacer elements, the layered passes flowing said first fluid including marginal spacer elements forming with adjacent plate elements a vent passage opening through said assembly face into said vent chamber of said manifold.

3. A leak protected heat exchanger according to claim 2, said vent passage being formed by a pair of marginal spacer elements in a parallel spaced apart relation, said plate elements superposing on said spacer elements.

4. A leak protected heat exchanger according to claim 2, the layered flow passes defining second fluid passes being defined by plate elements spaced apart by longitudinally spaced apart spacer elements including a spacer element located at and forming a part of said assembly external face, the said spacer element of said face being configured to provide a passage at surfaces thereof contacted by said plate elements communicating through said external face with the said vent chamber in said manifold.

5. A leak protected heat exchanger, including an assembly of stacked plate and fin and spacer elements defining layered flow passes for first and second fluid to pass in heat transfer relation to one another, means defining a vented buffer zone between first and second fluid flow passes receiving fluid leaked through said plate elements, means defining a vented buffer zone for fluids leaked through spacer element-plate element joints in first fluid flow passes, means defining a vented buffer zone for fluids leaked through spacer element-plate element joints in second fluid flow passes, said assembly being configured to provide an external face through which said buffer zones open, and including a manifold applied to said face incorporating a vent chamber in common communication with said buffer zones, said first fluid flow passes opening through said external face, and said manifold having first fluid flow passage means communicating with said first fluid flow passes to the exclusion of said buffer zones.

6. A leak protected heat exchanger according to claim 5, said means defining a vented buffer zone between first and second fluid flow passes providing a collection chamber between and substantially coextensive with said fluid flow passes.

7. A leak protected heat exchanger according to claim 5, said means defining a vented buffer zone for fluids leaked through joints of said first fluid flow passes providing a marginal vent passage in substantially surrounding relation to a first fluid flow pass in the plane thereof.

8. A leak protected heat exchanger according to claim 5, said means defining a vented buffer zone for fluids leaked through joints at said second fluid flow passes providing a vent passage within a spacer element at least at one end of a second fluid flow pass.

9. A leak protected heat exchanger, including an assembly of stacked plates and spacer elements defining layered flow passes for first and second fluids to pass in heat transfer relation to one another, plate elements being separated by marginal spacer elements and defining therewith plate element-spacer element joints, other spacer elements between adjacent first and second fluid flow passes defining a collection chamber for fluids leaked from said fluid flow passes through plate elements separating said fluid flow passes from said collection chamber, said other spacer elements being in a bounding enclosing relation to said collection chamber with provision being made for a venting of said collection chamber therethrough, said spacer elements being constructed and arranged to provide interior passages into which fluids leaked through said plate element-spacer element joints have access, the heat exchanger having an exterior face for manifold attachment through which face said collection chamber and said interior passages separately open.

10. A leak protected heat exchanger, including an assembly of stacked plates and spacer elements defining layered flow passes for first and second fluids to pass in heat transfer relation to one another, and defining between adjacent first and second fluid flow passes collection chambers for fluids leaked from said fluid flow passes through plate elements separating adjacent fluid flow passes from a collection chamber, the heat exchanger having an exterior face through which a first flowing fluid has access to first fluid flow passes, and means for venting said collection chambers through said exterior face, the access to said first fluid flow passes and said venting means being separated so that manifolding means applied to said face may provide for separate communication with said first fluid flow passes and with said venting means.

11. A leak protected heat exchanger according to claim 10, said spacer elements defining with adjacent contacting plates spacer element-plate joints, said spacer elements being constructed and arranged to provide interior passages into which fluids leaked through said joints from first and second fluid passes have access, said interior passages opening through said exterior face in a separated relation to the means venting said collection chambers.

* * * * *